United States Patent [19]

Lo

[11] Patent Number: 5,038,111

[45] Date of Patent: Aug. 6, 1991

[54] PARTICLE ACCELERATOR

[75] Inventor: Shui-Yin Lo, Pasadena, Calif.

[73] Assignee: Apricot S.A., Luxembourg, Luxembourg

[21] Appl. No.: 347,541

[22] Filed: May 4, 1989

[51] Int. Cl.[5] ..... H05H 3/04

[52] U.S. Cl. ..... 328/233; 313/359.1; 313/153; 333/99 PL

[58] Field of Search ..... 328/233, 256; 313/153, 313/156, 359.1; 333/99 PL; 250/423 R, 424

[56] References Cited

U.S. PATENT DOCUMENTS 4,641,103 2/1987 Madey et al. ..... 328/233 X 4,835,446 5/1989 Nation et al. ..... 328/233 X

*Primary Examiner*—Kenneth Wieder

*Attorney, Agent, or Firm*—Ladas & Parry

[57] ABSTRACT

A method of accelerating neutral plasma, consisting of electrons and positively charged ions, from low energy to high energy, by reflection of electromagnetic waves directed into the plasma, the frequency $\omega$ of the electromagnetic wave being smaller than the plasma frequency of the neutral plasma.

9 Claims, 1 Drawing Sheet

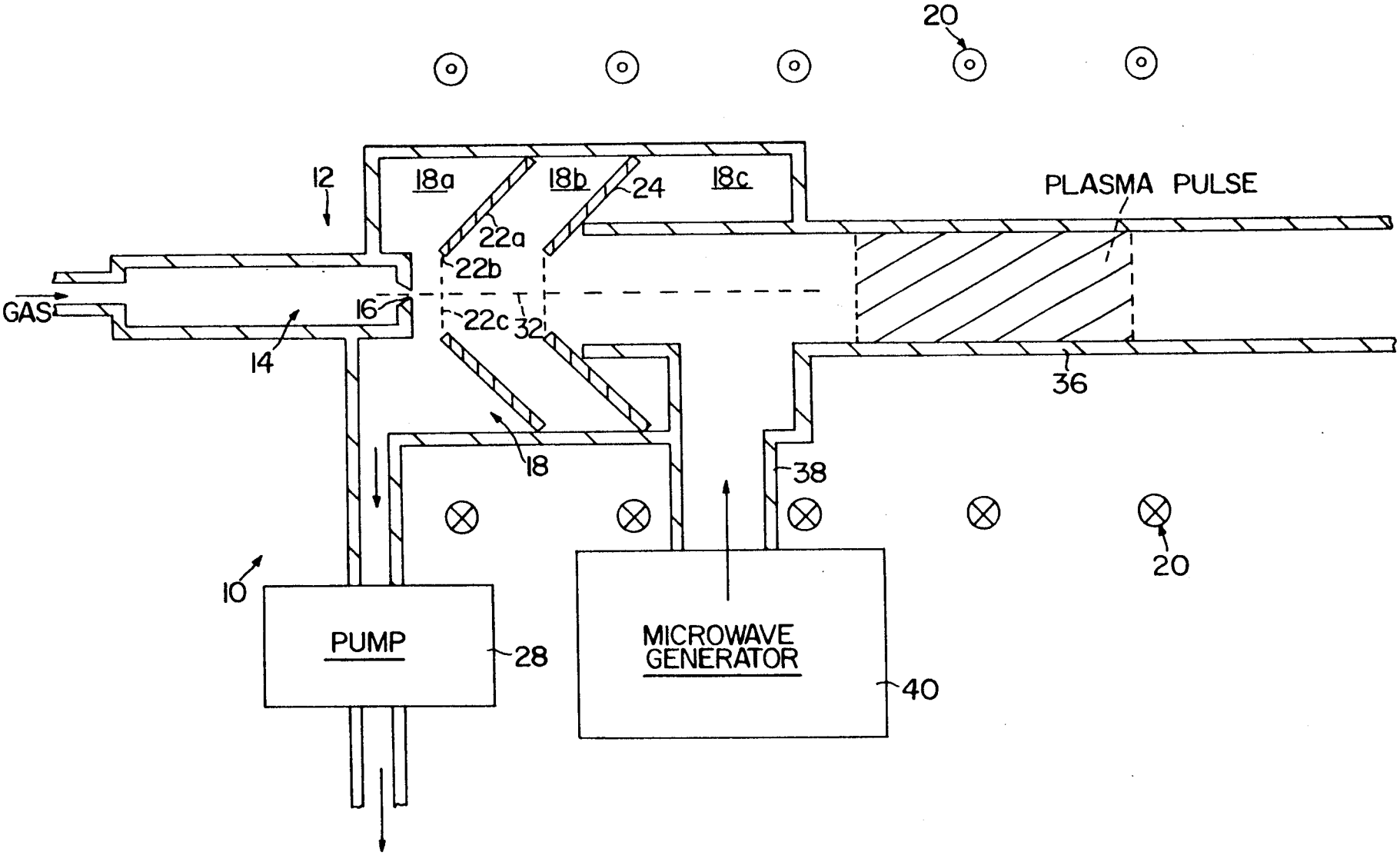
PLASMA PULSE
20
20
36
40
38
MICROWAVE GENERATOR
18c
24
18b
22a
22b
22c
32
18
18a
16
28
PUMP
12
14
10
GAS

PARTICLE ACCELERATOR

This invention relates to a particle accelerator.

Existing particle accelerators operate by accelerating charged particles to high energy. The principles of operation of these are described, for example, in 'Principles of Charged Particle Acceleration' by S. Humpheries Jr, published by John Wiley & Sons 1986. The most popular types are electron accelerators and proton accelerators. There are also many accelerators effective to accelerate ions. For charged particles, it is difficult to maintain a beam stable above a charge density of $10^8/cm^3$, because of the strong coulomb repulsion which exists between like charged particles. Hence, the obtaining of a much stronger beam with higher density, and hence higher current, is a difficult task. However, there is a need for device capable of generating such strong beams, for example, in nuclear fusion research. Two schemes have been proposed for effecting nuclear fusion using inertia confinement techniques with high power particle beams. One scheme, pioneered by the Sandia National Laboratory in New Mexico, involves using light ions as drivers for inertial fusion. The technique is described in the following publications:

J. P. Van Devender, AIP Conference Proceedings 152, Heavy Ion Inertia Fusion, Washington, D.C. 1986, edited by M. Keiser, T. Godlover & R. Bangerter, p. 568–578.

J. P. Van Devender, and T. P. Wright. Progress on the Particle Beam Fusion Accelerator II for Light Ion Fusion (1987). IEEE Particle Accelerator Conference, Mar. 16–19, 1987, Washington, D.C. pp. 1975–1978.

The dominant problem is the power concentration. A current project using this scheme is called Particle Beam Fusion Accelerator II (PBFAII) which is designed to generate and focus a lithium ion beam into a spherical target at $100TW/cm^2$. This project was begun in 1985, and great efforts have been directed in the last several years to create an ion diode which will generate lithium ion to the density of $10^{16}$ lithium ions/$cm^2$ in a 1 mm thick plasma. The ion diode is still however, in the research stage. The power supply is required to generate 2 MV at a current of 5 MA which is to be later upgraded to 30 MV for a duration of 50 ns. The ion diode has an area of 1000 $cm^2$.

Another scheme devised in order to overcome the space charge problem is that called heavy ion inertia fusion. The approach is to use many beams to be accelerated to a higher energy, and then recombine these into a single beam. Much effort has been expended on it in the United States, Germany and Japan. The following publications describe this scheme:

Heavy Ion Inertia Fusion, AIP Conference Proceedings 152, edited by M. Reiser et ., Washington, D.C. 1986. T. F. Godlove, A Decade of Acceleration, R & D for Heavy Ion Fusion, IEEE Particle Accelerator Conference Mar. 16–19, 1967, Washington, D.C., edited by E. R. Lindstrom and L. S. Taylor, pp. 1970–1974.

Instead of using a single charged particle beam one may attempt to use neutral plasma (which consists of electrons and ions). Plasma is relatively easy to create, but it has always in the past proven very difficult to accelerate a neutral object. The plasma from a plasma jet typically has energy of the scale of 1 eV per article. For fusion requirements, at least 1 MeV per particle or 1 GeV per particle is required. The crucial problem is then how to accelerate a very low energy plasma to a very high energy state.

According to the invention there is provided a method of accelerating neutral plasma, consisting of electrons and positively charged ions, from low energy to high energy, by reflection of electromagnetic waves directed into the plasma, the frequency $\omega$ of the electromagnetic waves being smaller than the plasma frequency of the neutral plasma.

The invention also provides a particle accelerator comprising means for generating substantially neutral plasma comprising electrons and positively charged ions, and means for accelerating the plasma from a low energy to a high energy, said means for accelerating comprising electromagnetic radiation generating means for generating an electromagnetic wave having a frequency $\omega$ which is smaller than the plasma frequency of the neutral plasma, vacuum chamber means for receiving the plasma and means for introducing thereinto the electromagnetic radiation from said generator means.

The invention is further described by way of example only with reference to the accompanying drawing, the single FIGURE of which is a schematic diagram of a particle accelerator constructed in accordance with the invention.

As mentioned, the mechanism employed in the embodiment to be described is the reflection of an electromagnetic wave by a plasma beam. When an electromagnetic wave of angular frequency $\omega$ is incident on a plasma which has a plasma frequency $\omega_p$ given by $$\omega_p = \left(\frac{4\pi\alpha n_e}{m_e}\right)^{\frac{1}{2}}$$

$n_e$=density of electron $m_e$=mass of electron $\alpha=1/137$ the electromagnetic wave will be reflected back provided that its frequency $\omega$ is smaller than $\omega_p$:

$$\omega<\omega_p$$

Because of the reflection, momentum and hence energy is transferred from the electromagnetic wave to the plasma. Hence, the plasma is accelerated.

Referring now to the FIGURE, the accelerator 10 shown therein comprises a plasma source 12 such as that described in U.S. patent application Ser. No. 103,631 filed Oct. 1, 1987. The plasma is generated by microwave radiation in a microwave plasma generator 14 at high pressure, then allowed to expand through a nozzle 16 into an expansion chamber 18 where the neutral gas is pumped away by pump 28. The plasma is confined as a beam 32 by an axial magnetic field generated by a solenoid 20. Two sets of skimmers 22, 24 are placed in the expansion chamber to collimate the beam as well as to separate three regions **18*a*, 18*b*, 18*c* of the expansion chamber with different levels of vacuum. The last region 18*c* is connected to a long acceleration tube 36** in which the plasma is accelerated.

Microwave radiation of frequency $\omega$ which is smaller than the plasma frequency $\omega_p$ of the plasma is generated by a suitable generator 40 and fed into the beginning of the tube 36 via a suitable waveguide 38. Accordingly, the plasma is constrained such that, if it is to continue, it will be chopped into pulses before it enters into the acceleration tube. The microwave radiation which then is also in pulse form will follow after the plasma pulse has passed. Since the plasma travels at quite a low speed, say $10^5$ cm/sec to $10^6$ cm/sec for a typical microwave generated plasma emitted from a nozzle, the microwave radiation pulse travels close to the speed of light in the acceleration tube. The microwave radiation pulse will catch up to and be reflected from the plasma pulse. When the microwave radiation pulse is so reflected, it loses energy, and the plasma gains energy. The microwave pulse will travel backwards to the last set of skimmers. The skimmer 22 is made of a conductor and a central hole **22*b* of the skimmer is covered with wire mesh 22*c*. The microwave radiation pulse is then reflected back from the skimmer 22 and travels forward again. Since the skimmer 22** is immovable, the microwave pulse does not lose energy in this reflection. The microwave pulse, travelling at a higher speed, will catch up to the plasma pulse and be reflected by the plasma. The plasma pulse then gains energy from the microwave pulse and moves even faster forward. So each microwave radiation pulse bounces between the plasma pulse and the last set of skimmers till it loses significant part of energy to the plasma pulse. As the microwave pulse loses its energy, its frequency $\omega$ drops, and then it is always smaller than plasma frequency ($\omega<\omega_p$).

The plasma may for example, have an electron density $n_e=10^{14}/cm^3$, which gives a plasma frequency of $$f_p=\omega_p/2\pi=91 \text{ GHz}$$

which amounts to a wave length of $$\lambda_p\approx 3 \text{ mm}$$

The microwave pulse should have a frequency $$f=\omega/2\pi<f_p$$

or a wave length larger than $\lambda_p$ $$\lambda>\lambda_p$$

In order to transmit the microwave pulse, the acceleration tube may be a square cross section tube with sides of transverse dimension a, b. If a=2 mm and b=4 mm, the wave length of microwave obeys the following inequality:

$$2a>\lambda>\lambda_p$$

so that it will be reflected by the plasma as well as transmitted by the tube. There is a general cutoff frequency $\omega_\lambda$ in a wave-guide where the frequency $\omega$ of the transmitted wave must exceed $\omega_\lambda$ in order to be transmitted.

For a plasma pulse of length $\rho$, the volume of the plasma pulse is $$V=a\times b\times\rho=2 \text{ mm}\times 4 \text{ mm}\times 1.25 \text{ cm}=0.1 \text{ cm}^3$$

with $\lambda=2.5$ cm. For ion density $n_i=n_e=10^{14}/cm^3$, the total number of ions in the pulse is $$N_i=n_iV=10^{13}$$

Suitable devices for use as generator 40 include commercially available gyrotrons made by Varian, Type VGB-8007A1 having an operating frequency of 700 GHz with a power of P=400 kW. Alternatively, a pulsed magnetron may be used, such as that described in the book by R. B. Miller, "an Introduction to the Physics of Intense Charged Particle Beams", Plenun Press (1982), at page 215. If the microwave radiation from the gyrotron is piped into pipe 36 for a time $\tau$, the total energy $E_\gamma$ in the microwave pulse is $$E_\gamma=\tau P$$

where P is the power. Then the energy that the ions in the plasma absorb is $E_i$.

$$E_i=E_\gamma/N_i\epsilon$$

where $\epsilon$ is the efficiency of absorption. The following exemplary numerical values then prevail.

TABLE (1)

| | $\tau$ | $E_\gamma$ | $E_i$ (eV) $\epsilon$ = 100% | $E_i$ (eV) $\epsilon$ = 10% |
|---|---|---|---|---|
| (A) | 1 μs | 0.4 Joule | 240 keV | 24 keV |
| | 10 μs | 4.0 Joule | 2.4 MeV | 240 keV |
| | 41 μs | 16.4 Joule | 10 MeV | 1 MeV |
| (B) | 0.1 μs | $10^2$ Joule | ~100 MeV | ~10 MeV |

(A) From pulsed gyrotron. P = 400 kW
(B) From pulsed magnetrons. P = 1 GW

For a pulsed magnetron, it is possible to have power greater than 1GW for a duration of 100 nsec. The energy of the microwave pulse is $E_2$ $10^2$ Joule:, and the energy per ion is of the order 10–100 MeV.

The nature of the conserations appertaining to the plasma frequency above mentioned, will be further evident from the following where:

$\lambda$: wave length of the microwave that is driving the plasma $\lambda_p$: wave length of the plasma to be accelerated cut off wave length due to the transmission tube (wave guide).

The following inequality is required:

$$\lambda_p<\lambda<\lambda_c$$

or $$\omega_p>\omega>\omega_c$$

The condition is $\omega_p>\omega$ so that microwave will be reflected by the plasma.

The condition of $\omega>\omega_c$ so that microwave will not be cut off by the transmission tube.

The plasma frequency is given by $$\omega_p=\sqrt{\frac{4\pi\alpha n}{m_e}}$$

n: density of the electron in the plasma $m_e$: mass of electron $\alpha=1/137$ $\lambda_p=2\pi c/\omega_p$ The skin depth of a plasma is defined as $\delta_p=c/\omega_p$ Beyond such a depth in the plasma the microwave cannot penetrate.

$$f_p=\omega_p/2\pi$$

$\lambda_p = 2\pi\delta_p$

Table 2 lists some of the numerical values for all these parameters related to the plasma.

TABLE 2

| $n_p/cm^3$ | $\omega_p$ | $f_p$ GHZ | $\delta_p$ | $\lambda_p$ | $\lambda_{p/2}$ |
|---|---|---|---|---|---|
| $10^{10}$ | $5.75 \times 10^9$ | 914 MHZ | 5.22 cm | 32.8 cm | 16.4 cm |
| $10^{11}$ | $1.82 \times 10^{10}$ | 2.89 GHZ | 1.65 cm | 10.4 cm | 5.2 cm |
| $10^{12}$ | $5.75 \times 10^{10}$ | 9.14 GHZ | 5.22 mm | 3.28 cm | 1.64 cm |
| $10^{13}$ | $1.82 \times 10^{11}$ | 28.9 GHZ | 1.65 mm | 1.04 cm | 5.2 mm |
| $10^{14}$ | $5.75 \times 10^{11}$ | 91.4 GHZ | 0.522 mm | 3.28 mm | 1.64 mm |
| $10^{15}$ | $1.82 \times 10^{12}$ | ·289 GHZ | .165 mm | 1.04 mm | 0.52 mm |
| $10^{17}$ | $5.75 \times 10^{12}$ | 914 GHZ | 0.0522 mm | 100 μm | 52 μm |

The cut off frequency is related to the dimension of a rectangular wave guide with cross section a×b, with a>b.

Then $a = \lambda_{c/2}$.

TABLE 3

| f | $\lambda_c$ | $\lambda_c/2 = a$ |
|---|---|---|
| 1 GHZ | 30 cm | 15 cm |
| 2 | 15 | 7.5 |
| 10 | 3 | 1.5 cm |
| 20 | 15 | 7.5 mm |
| 30 | 1 cm | 5.0 mm |
| 40 | 7.5 mm | 3.9 mm |

For example, choosing a tube with a=6.0 mm, then a microwave with frequency f=30 GHZ can pass through it. But the plasma should have a density $n > 10^{13}/cm^3$.

I claim:

1. A method of accelerating neutral plasma, consisting of electrons and positively charged ions, from low energy to high energy, by reflection of electromagnetic waves directed into the plasma, the frequency ω of the electromagnetic wave being smaller than the plasma frequency of the neutral plasma.

2. A method of accelerating neutral plasma, as claimed in claim 1 wherein the neutral plasma is directed in a beam and the electromagnetic waves are directed into the beam with a component of motion in the direction of movement of the beam.

3. A method of accelerating neutral plasma as claimed in claim 2 wherein the electromagnetic waves comprise microwave radiation travelling in a wave guide, the wave guide also serving as an accelerating tube for the plasma.

4. A method of accelerating neutral plasma as claimed in claim 3 wherein the entrance for the plasma into the accelerating tube is closed by a conducting wire mesh, permitting a substantial portion of the plasma to pass therethrough but reflecting the microwave radiation.

5. A particle accelerator comprising means for generating substantially neutral plasma comprising electrons and positively charged ions, and means for accelerating the plasma from a low energy to a high energy, said means for accelerating comprising electromagnetic radiation generating means for generating an electromagnetic wave having a frequency ω which is smaller than the plasma frequency of the neutral plasma, vacuum chamber means for receiving the plasma and means for introducing thereinto the electromagnetic radiation from said generator means.

6. Apparatus as claimed in claim 5 wherein said vacuum chamber means includes a waveguide which defines an accelerating tube into which the neutral plasma is in use directed and into which said electromagnetic wave is in use directed.

7. Apparatus as claimed in claim 6 wherein an enterance to said accelerating tube is covered by a conducting wire mesh so arranged as to permit a substantial portion at least of the plasma to pass therethrough but to reflect the microwave radiation.

8. Apparatus as claimed in claim 6 including means for generating a magnetic field for confining said beam in said accelerating tube.

9. Apparatus as claimed in claim 7 including means for generating a magnetic field for confining said beam in said accelerating tube.

* * * * *